United States Patent [19]

Plohberger et al.

[11] Patent Number: 5,025,769

[45] Date of Patent: Jun. 25, 1991

[54] DEVICE FOR FEEDING FUEL INTO A COMBUSTION CHAMBER OF AN INTERNAL COMBUSTION ENGINE

[76] Inventors: Diethard Plohberger, Deutschlandsberg; Volker Pichl; Leopold Mikulic, both of Graz, all of Austria

[21] Appl. No.: 553,660

[22] Filed: Jul. 18, 1990

[30] Foreign Application Priority Data

Jul. 31, 1989 [AT] Austria ..... 1847/89

[51] Int. Cl.[5] ..... F02M 69/08

[52] U.S. Cl. ..... 123/532; 123/316

[58] Field of Search ..... 123/531, 532, 533, 534, 123/316

[56] References Cited

U.S. PATENT DOCUMENTS

| | | | |
|---|---|---|---|
| 2,103,595 | 12/1937 | Nelson | 123/532 X |
| 2,783,747 | 3/1957 | Layne | 123/532 X |
| 3,205,876 | 9/1965 | Stuhr | 123/532 X |
| 4,406,260 | 9/1983 | Burley | 123/316 X |
| 4,771,754 | 9/1988 | Reinke | 123/532 X |
| 4,865,002 | 9/1989 | Borst et al. | 123/532 |
| 4,974,571 | 12/1990 | Oppenheim et al. | 123/532 X |

FOREIGN PATENT DOCUMENTS

| | | | |
|---|---|---|---|
| 0151450 | 12/1931 | Canada | 123/532 |

*Primary Examiner*—Willis R. Wolfe

*Attorney, Agent, or Firm*—Watson, Cole, Grindle & Watson

[57] ABSTRACT

For control of the injection rate of a device for feeding fuel into the combustion chamber of an internal combustion engine, comprising an injection valve opening into the combustion chamber, which is used for taking compressed gas from the cylinder and injecting it together with the fuel supplied by a metering device, and further comprising a gas storage cell for holding the compressed gas, the proposal is put forward that a variable throttle be provided between the valve seat of the injection valve and the gas storage cell, whose flow cross-section can be controlled in accordance with load and speed parameters of the engine.

11 Claims, 2 Drawing Sheets

DEVICE FOR FEEDING FUEL INTO A COMBUSTION CHAMBER OF AN INTERNAL COMBUSTION ENGINE

BACKGROUND OF THE INVENTION

This invention relates to a device for feeding fuel into the combustion chamber of an internal combustion engine, comprising an injection valve opening into the combustion chamber, which is used for taking compressed gas from the cylinder and injecting the gas together with the fuel supplied by a metering device, and further comprising a gas storage cell holding the compressed gas.

DESCRIPTION OF THE PRIOR ART

A device of this type is described in EP-A 0 328 602, for example, where a gas exchange chamber is controlled by an injection valve opening into the cylinder of an internal combustion engine. In this variant compressed gases are taken from the cylinder during one working cycle, and are stored temporarily, and are then injected into the cylinder of the internal combustion engine during the subsequent working cycle, together with the fuel fed into the gas exchange chamber on the side of the valve.

As regards adjustment of control times of the injection device to various engine parameters such as load or speed, several variants permitting control of the lifting rate of the valve needle or a change of the needle lift are described in EP-A 0 328 602. The advantages over versions without variable needle lift become apparent when the engine is operated at low load or at full load, above all, the positive influence on the emission behavior of the engine.

In the above device possible eccentricities in the position of the injection valve relative to the valve seat may have a negative influence on the shape of the fuel jet, however,—in particular with small valve lifts—, which will make special demands on the quality of valve stem guide and valve seat. Besides, control of the valve lift requires considerable technical expense and production efforts.

SUMMARY OF THE INVENTION

It is an object of the invention to develop a device of the above type in a mechanically simple manner such that optimum conditions of injection are achieved even for small injection volumes and low injection rates during operation under conditions of idling or partial load, while permitting possible eccentricities in the area of the valve seat.

In the invention this object is achieved by providing a variable throttle between the valve seat of the injection valve and the gas storage cell, whose flow cross-section can be controlled in accordance with load and speed parameters of the engine. The use of separate elements for controlling injection time and injection rate, i.e., an injection valve with constant needle lift on the one hand and a variable throttle on the other hand, will permit functional improvements and better adaptation to the available space, which is different for different engines and assemblies. Due to the constant needle lift, which is comparatively large, faults in the valve seat will have no adverse effects on the shape of the fuel jet.

In this version control of the injection rate or the amount of gas entered per unit time is performed by a variable throttle located behind the now constant throttle of the valve seat, unlike in the known device, where this control is obtained by varying the lift of the injection valve. Connecting elements for connection with the gas storage cell are configured so as to contain only a small volume, such that most of the stored gas will pass the variable throttle both when the storage cell is being charged and when the fuel/gas mixture is injected into the combustion chamber.

Depending on the flow cross-section opened at the site of the variable throttle the flow of gas entering the storage cell during the filling process is throttled more or less, which will lead to a higher or lesser pressure level in the gas storage cell after the injection valve has closed.

When the injection valve is opened again during the subsequent injection process, the pressure difference between cylinder and storage cell, and thus the energy available for the injection process, is greater or smaller, depending on the position of the throttle, the beginning of injection being kept constant. In addition, the gas flowing from the gas storage cell during the injection period is throttled by a varying degree, depending on the position of the throttle.

As a consequence a comparatively small volume of gas is exchanged during the injection process if the throttle is in a more or less closed position, and the gas stored in the storage cell flows out at comparatively low speed during injection. If the throttle is open the reverse is true; a large gas volume is exchanged and injection is performed at a high rate.

In this manner the injection jet may be adapted to the different demands made by different operational states of the engine. At partial load, for instance, a weak injection jet is useful for obtaining a good stratification of the charge in the combustion chamber, whereas at full load a high injection rate will bring about the desired homogeneity of the charge in the combustion chamber.

Another advantage over known devices is that it is mechanically simpler and less expensive to control a throttle element than to control the valve lift.

Another variant of the invention provides that the gas storage cell be configured as a rotatable or axially movable storage tube, which is held in the housing of the injection valve and is provided with an adjusting element and a wall opening connected via a feed line to an annular chamber adjoining the valve seat, the variable throttle being formed by the opening in the wall of the storage tube and the corresponding feed line into this tube, and the metering device preferably opening into the annular chamber adjoining the valve seat. The storage tube may be rotated to vary the area of overlap of the two openings. This will result in different cross-sections available for the gas flow.

In a particularly advantageous variant of the invention the individual injection valves of a multi-cylinder engine have a joint storage tube located parallel to the crankshaft axis, which is held by lateral projections on the housings of the individual injection valves and is divided into individual storage sections, each of which is connected via a wall opening to a feed line of the corresponding injection valve. Due to the lateral and horizontal arrangement of the storage tube the height of the injection device may be kept small, which is required especially for two-stroke engines.

It may be provided in the invention that the individual storage sections in the storage tube be connected by throttling ports, thus establishing identical mean pressures in the individual sections.

Further improvement is achieved by providing that the feed line located between the annular chamber adjoining the valve seat and the gas storage cell, open into the annular chamber tangentially, which will impart a stabilising torque to the injection jet.

In another variant of the invention, which is particularly well suited for four-stroke engines, a tubular throttling element is provided, which can be shifted axially and surrounds the valve guide of the injection valve, and whose end facing the valve seat has a cylindrical gap towards the housing of the injection valve, acting as the variable throttle between valve seat and gas storage cell. Since no space is available for a lateral and horizontal storage tube due to the space required for the valve gear, the gas storage cell is placed coaxial with the injection valve in this variant.

In an enhanced version of the invention the metering device may open into the annular gap between injection valve and valve guide.

If the throttling element is actuated pneumatically, i.e., preferably by the fuel pressure generated by a pump, the proposal is put forward that the throttling element carry an annular plate at its far end away from the valve seat, which should be movably sealed against the wall of the housing, and that the annular plate should separate two annular chambers located in the valve housing, one of these annular chambers, which is subject to a control pressure medium, being separated from the gas storage cell by means of an annular projection in the valve housing, and the other annular chamber being provided with an element or medium operating in closing direction of the throttling element.

Finally it is possible according to the invention that the annular chamber containing a pressure medium which is effective in closing direction of the throttling element, have a flow-connection into the gas storage cell. In this way automatic control is obtained of the pressure in the gas storage cell.

BRIEF DESCRIPTION OF THE DRAWINGS

The invention will be further described by way of example only with reference to the accompanying drawings, in which.

DETAILED DESCRIPTION OF PREFERRED EMBODIMENTS

Instead of separate discussions of the numerous possible variants of the invention two significant variants will be discussed in detail below, corresponding to FIGS. 1, 2 and 3, respectively.

Figure 1:
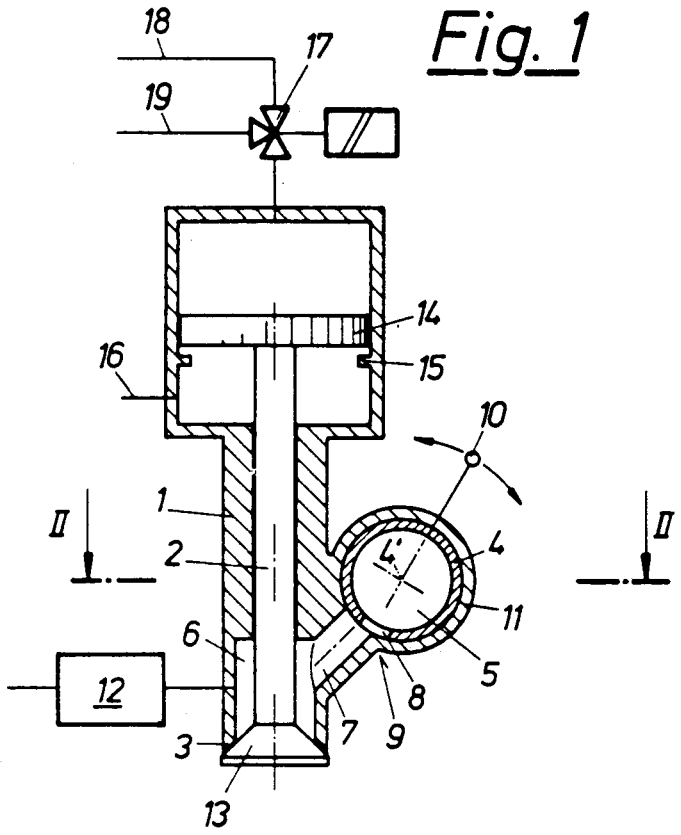
FIG. 1 shows a device according to the invention, as a section along line I—I in FIG. 2.

The device for feeding fuel into the combustion chamber of an internal combustion engine shown in FIG. 1 has an injection valve 2 guided in a housing 1. Between the valve seat 3 of the injection valve 2 and the gas storage cell 5 configured in this variant as a storage tube 4 rotatable about its axis 4', a feed line 7 into the storage cell 5 is provided, which departs from an annular chamber 6 adjacent to the valve seat 3. The wall opening 8 in the storage tube 4 and the feed line 7 cooperating with this opening together form the variable throttle 9. By means of an adjusting element 10 the storage tube 4 can be rotated and the overlap of the wall opening 8 and the feed line 7 can be varied accordingly, which in turn will give a variable gas flow through the throttle 9. In order to save space the storage tube 4 may be positioned in a lateral projection 11 of the housing 1, which will result in a compact design especially for two-stroke engines.

The fuel is fed via the metering device 12 into the annular chamber 6 near the valve disk 13 of the injection valve 2, such that the entire volume of incoming or outgoing gas may be charged with fuel in each operational state of the engine.

The mode of actuation of the injection valve 2 is freely selectable; to ensure a small overall height, short opening and closing periods and precise control while permitting variations of the injection timing it is recommended, however, to open and close the valve with the use of the pressure generated by a fuel pump, as described in EP-A 0 328 602 mentioned at the beginning of this paper. The fuel pump also supplies the metering device 12 used for fuel injection into the annular chamber 6.

To open the valve an actuating plunger 14 connected with the injection valve is subjected to high pressure (20 to 100 bar) on the side facing away from the valve seat 3, and is thus pressed against a stop 15 in the housing 1. The travel length of this movement corresponds to the lift of the injection valve 2. The valve is closed by the constant pressure of a pressure medium delivered via line 16, which is applied to the other side of the actuating plunger 14.

The actual opening and closing of the valve is effected via a solenoid-controlled three-way valve 17 opening the high pressure line 18 from the beginning of the opening cycle of the injection valve 2 to the time of its immediate closing, and thus acting upon the actuating plunger 14 on the side away from the valve. The pressure applied to the other side of the plunger either is lower than the high pressure from line 18, or different actuating forces are produced at the plunger by making the pressure-effective areas on the two sides of the plunger different in size. In this way no second pressure level is needed.

For closing the injection valve 2 the three-way valve 17 releases the return line 19. The pressure on the side of the plunger away from the valve decreases, and the pressure applied to the other side via line 16 will close the injection valve 2 and keep it closed against the gas pressure in the storage cell.

Figure 2:
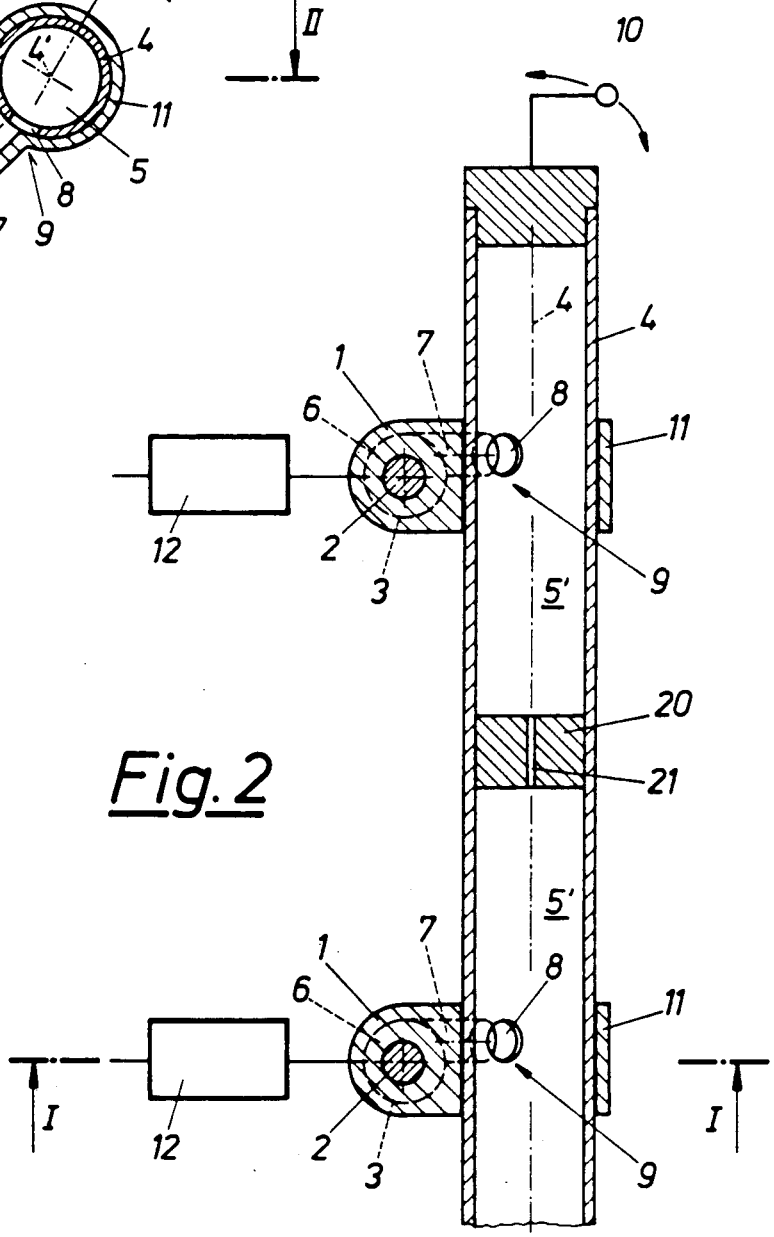
FIG. 2 shows the device of FIG. 1, as a section along line II—II in FIG. 1.

In multi-cylinder engines the storage tube 4 is placed parallel to the crankshaft axis, thus connecting the injection valves 2 arranged in line (FIG. 2). The storage tube 4 is held in the lateral projections 11 of the housings 1 of the individual injection valves 2, and is divided into individual storage sections 5'. Each storage section 5' is connected with a feed line 7 of the respective injection valve 2 via a wall opening 8.

In between the individual storage sections 5' throttling ports 21 are placed in partition walls 20, which ports are configured so as to produce identical mean pressures in the individual storage sections 5' corresponding to the individual cylinders. This is effected in such a way, however, that the different timings of the injection processes of the individual injection valves and the subsequent differences in the instantaneous pressures in the individual storage sections 5' do not interfere with one another. Arranging the gas storage cells of all injection devices of a cylinder bank in a joint and rotatable storage tube 4 offers the advantage that only one single adjusting element 10 is required for rotation of the storage tube 4 and thus for control of the variable throttle passages 9. The rotatory motion of the storage tube 4 also is of advantage.

In order to compensate for possible changes in length or tolerances in the direction of axis 4' of the storage tube 4 the wall openings 8 of the storage tube 4 may be configured as slots at the site of the variable throttle 9.

The feed line 7 into the storage section 5' is best configured so as to permit the gas emerging from the storage section 5' upon injection to enter the annular chamber 6 around the injection valve 2 tangentially. In this way the injection jet is imparted a stabilising torque.

Figure 3:
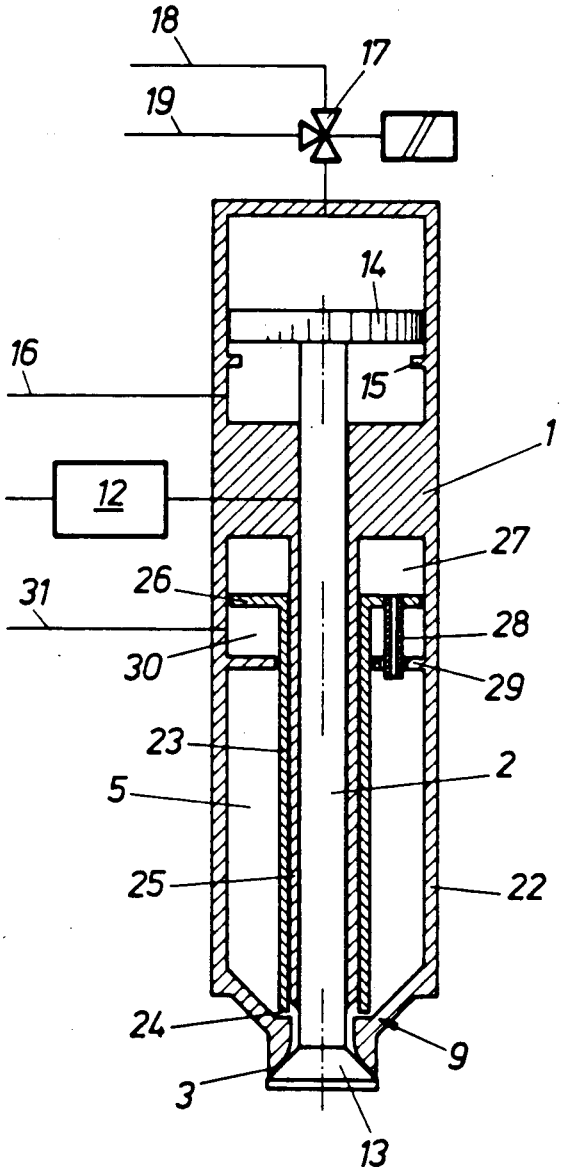
FIG. 3 shows another variant of the invention.

In the variant of the invention presented in FIG. 3 all parts corresponding to those in the variant of FIGS. 1 and 2 have the same reference numbers again. The gas storage cell 5 now is coaxial with the injection valve 2 and is bounded by the cylindrical wall 22 of the housing 1. The variable throttle 9 between valve seat 3 and storage cell 5 is constituted by the valve-side end of a throttling element 23 forming a variable, cylindrical gap 24 together with the housing 1 of the injection valve 2. The tubular throttling element 23 surrounds the valve guide 25 on which it slides axially, such that the height of the cylindrical gap and thus the cross-section of the throttle 9 may be varied linerarly. In order to avoid any adverse effects of inaccuracies in the guiding of the throttling element 23, the throttle 9 closes with a flat seat.

Due to its structural shape and outer dimensions the variant shown here is mainly suitable for use in four-stroke engines.

Since the throttle 9 is rotationally symmetrical around the axis of the injection valve 2, and the flow conditions on the way into and in the storage cell 5 are also symmetrical, as is the fuel delivery via the annular gap between valve guide 25 and injection valve 2, it is possible to obtain good stratification of the charge in the gas storage cell 5. In this way it will be possible even as the gas is flowing into the storage cell to charge with fuel only that air volume which is entered into the cylinder during the subsequent injection process, bringing advantages for the non-stationary operation of the internal combustion engine.

Feeding the fuel from above via the valve guide 25 also is of advantage because of the fact that the fuel feed connection and the metering device 12 are located at a higher point, which is usually desirable in four-stroke engines with their large heights. Moreover, in designs where the fuel flows along the injection valve 2, valve stem and valve guide 25 are protected against the build-up of dirt.

In addition to various ways of actuating the throttling element 23 mechanically, the solution shown in FIG. 3 is recommended, i.e. automatic adjustment of the pressure in the gas storage cell 5 in accordance with a variable pressure level to be given, which level in turn can be controlled in accordance with performance characteristics. As described above, the pressure in the gas storage cell 5 is the decisive variable for the injection rate. The upper end of the throttling element 23 is shaped as an annular plate 26, which is movably sealed against the wall 22 of the housing of the injection valve 2. The annular chamber 27 thus formed between the housing wall 22 and the throttling element 23 has a flow-connection 28 to the gas storage cell 5. Below the plate 26 of the throttling element 23 an annular projection 29 is provided in the housing 1, which is parallel to the plate 26 and is movably sealed against the tubular throttling element 23. In this way an annular chamber 30 is formed between the annular plate 26 and the projection 29, which is necessary for control of the throttle and is subjected to the variable control pressure via the connection 31.

If a control pressure is given, it will act on the underside of the annular plate 26, the gas pressure in the annular chamber 27 acting as a counterforce on the other side of the plate. If the force of the control pressure is larger the throttling element 23 slides upwards axially. As a consequence the flow cross-section at the variable throttle 9 is enlarged and the gas pressure in the gas storage cell 5 is increased. Via the flow connection 28 gas from the gas storage cell 5 will flow into the annular chamber 27, and the higher pressure prevailing in the storage cell is established in the annular chamber as well. The process of adjusting the valve and thus the pressure in the storage cell is terminated when a balance of forces is achieved between the upper side and the underside of the plate 26 of the throttling element 23. If the control pressure in the annular chamber 30 is reduced the throttling element 23 slides downwards in axial direction due to the pressure in the annular chamber 27, which is stronger now than the control pressure. The gap 24 opened by this movement is reduced at the site of the variable throttle 9 and the pressure in the gas storage cell and in the annular chamber 27 is lowered. Again, the adjusting process ends when a balance of forces is established at the throttling element 23.

The throttling effect of the flow-connection 28 should be adjusted so as to obtain a medium pressure in the annular chamber 27, while the pressure changes in the storage cell taking place in every injection cycle are prevented from having any effects.

Instead of the flow connection 28 communication between the gas storage cell 5 and the annular chamber 27 may also be established by a gap between the throttling element 23 and the valve guide 25. In this instance the seal against the annular chamber 30 is superfluous, which is otherwise needed for regulation of the throttle.

If a fluid is used as a control pressure medium oscillations from the engine cannot lead to any unchecked motion of the throttling element 23, since due to the incompressibility of the fluid each movement of the throttling element relative to the housing of the injection valve would require a comparatively large change of the volume in the annular chamber 30, which is counteracted by the throttling force generated by the comparatively small cross-section of the connection 31.

It is an advantage of this system that temperature-dependent changes in length and manufacturing tolerances of throttle element and injection valve do not affect the set pressure in the gas storage cell 5, since this pressure is continuously adjusted directly in accordance with the given control pressure. This will also permit controlling and synchronising of the injection rates of several injection devices in a simple manner, by subjecting them to the same control pressure.

We claim:

1. A device for feeding fuel into a combustion chamber of an internal combustion engine, comprising an injection valve with a valve seat, said injection valve opening into said combustion chamber and being used for taking compressed gas from said combustion chamber into a gas storage cell holding said compressed gas, and for injecting said compressed gas together with fuel supplied by a metering device, wherein a variable throttle is provided between said valve seat of said injection valve and said gas storage cell and wherein the flow cross-section of said variable throttle is controllable in accordance with load and speed parameters of said internal combustion engine.

2. A device according to claim 1, wherein said gas storage cell is configured as a rotatable or axially movable storage tube, which is held in a housing of said injection valve, said storage tube is provided with an adjusting element and a wall opening connected via a feed line to an annular chamber adjoining said valve seat, said variable throttle being formed by said wall opening in said storage tube and said corresponding feed line into said tube cooperating with said wall opening.

3. A device according to claim 2, wherein said metering device opens into said annular chamber adjoining said valve seat.

4. A device according to claim 2, wherein individual injection valves of a multi-cylinder engine have a joint storage tube located parallel to the crankshaft axis of said multi-cylinder engine, said joint storage tube is held by lateral projections on said housings of said individual injection valves and is divided into individual storage sections, each of said individual storage sections is connected via a wall opening to a feed line of said corresponding injection valve.

5. A device according to claim 4, wherein said individual storage sections in said storage tube are connected by throttling ports, establishing identical mean pressures in said individual storage sections.

6. A device according to claim 2, wherein said feed line located between said annular chamber adjoining said valve seat and said gas storage cell opens tangentially into said annular chamber.

7. A device according to claim 4, wherein each of said feed lines located between said annular chamber adjoining each of said valve seats and each of said individual storage sections opens tangentially into said annular chamber.

8. A device according to claim 1, wherein said gas storage cell is positioned coaxially with said injection valve having a tubular valve guide and being bounded by a cylindrical wall of said injection valve, wherein a tubular throttling element is provided, which is movable axially and surrounds said valve guide of said injection valve, one end of said tubular throttling element facing said valve seat forming a cylindrical gap towards said wall of said injection valve, acting as said variable throttle between said valve seat and said gas storage cell.

9. A device according to claim 8, wherein said metering device opens into said annular gap between said injection valve and said valve guide.

10. A device according to claim 8, wherein said tubular throttling element carries an annular plate at one end opposite from said cylindrical gap, said annular plate is movably sealed against said cylindrical wall of said injection valve, and wherein said annular plate separates a first annular chamber from a second annular chamber located in said injection valve housing, said first annular chamber, which is subject to a control pressure medium, being separated from said gas storage cell by means of an annular projection in said cylindrical wall, and said second annular chamber being provided with an element or medium operating in closing direction of said throttling element.

11. A device according to claim 10, wherein said second annular chamber containing a pressure medium which is effective in closing direction of said throttling element, has a flow-connection into said gas storage cell.

* * * * *

UNITED STATES PATENT AND TRADEMARK OFFICE

CERTIFICATE OF CORRECTION

PATENT NO. : 5,025,769

DATED : June 25, 1991

INVENTOR(S) : Diethard Plohberger et al.

It is certified that error appears in the above-identified patent and that said Letters Patent is hereby corrected as shown below:

On the title page, please insert the following:

[73] Assignee: AVL GESELLSCHAFT FUR
VERBRENNUNGSKRAFTMASCHINEN
UND MESSTECHNIK M.B.H.Prof.Dr.Dr.h.c.
HANS LIST

Signed and Sealed this

Third Day of November, 1992

*Attest:*

DOUGLAS B. COMER

*Attesting Officer*

*Acting Commissioner of Patents and Trademarks*